United States Patent [19]

Howard

[11] Patent Number: 4,731,945

[45] **Date of Patent: * Mar. 22, 1988**

[54] COMPACT ALTERNATIVE MESSAGE SIGN

[76] Inventor: John Howard, 2230 Durant, #204, Berkeley, Calif. 94704

[ * ] Notice: The portion of the term of this patent subsequent to Nov. 18, 2003 has been disclaimed.

[21] Appl. No.: 905,620

[22] Filed: Sep. 12, 1986

Related U.S. Application Data

[63] Continuation-in-part of Ser. No. 700,492, Feb. 11, 1985, Pat. No. 4,622,770.

[51] Int. Cl.[4] ..... G09F 11/00

[52] U.S. Cl. ..... 40/491; 40/488

[58] Field of Search ..... 40/491, 488, 907

[56] References Cited

U.S. PATENT DOCUMENTS

| | | | |
|---|---|---|---|
| 2,897,617 | 8/1959 | Haupt | 40/491 |
| 3,748,767 | 7/1973 | Giesecke | 40/491 |
| 4,177,593 | 12/1979 | Lockey | 40/491 |
| 4,217,713 | 8/1980 | Greenberger | 40/491 |
| 4,485,576 | 12/1984 | Greenberger | 40/491 |
| 4,622,770 | 11/1986 | Howard | 40/491 |

FOREIGN PATENT DOCUMENTS

| | | | |
|---|---|---|---|
| 745356 | 5/1933 | France | 40/491 |
| 633767 | 2/1982 | France . | |
| 441846 | 1/1936 | United Kingdom | 40/491 |
| 753590 | 11/1954 | United Kingdom | 40/491 |
| 1176837 | 1/1970 | United Kingdom | 40/488 |

*Primary Examiner*—Robert P. Swiatek
*Assistant Examiner*—Cary E. Stone
*Attorney, Agent, or Firm*—Limbach, Limbach & Sutton

[57] ABSTRACT

A compact sign is disclosed in which alternative messages are displayed, such as "OPEN" or "CLOSED". The signs use certain of the letters in each of the messages, for example "O" and "E" in the OPEN-CLOSED embodiment. The signs have three panels: a front panel with an aperture through which the other two panels may be viewed; a middle panel having one or more one space apertures through which information on the back panel may be viewed, as well as either blank spaces or information in other spaces; and a back panel with either blank spaces or information. The middle panel slides one space to reveal the alternate message.

10 Claims, 21 Drawing Figures

COMPACT ALTERNATIVE MESSAGE SIGN

This application is a continuation-in-part of co-pending application Ser. No. 700,492 filed Feb. 11, 1985 now U.S. Pat. No. 4,622,770.

BACKGROUND OF THE INVENTION

Signs showing the status of the location where the sign is placed take many configurations. Probably the most popular is the "OPEN-CLOSED" sign used in retail establishments. When the store opens, a clerk turns the sign to display "OPEN" printed on one side. When it closes, the sign is turned over to display "CLOSED". While in widespread use, the signs are subject to considerable wear in being turned over at least twice each business day. Moreover, they are unattractive and are not visible for a very great distance from the sign.

For many years, people have been trying to display alternative messages with signs that slide between one of two modes. However, virtually all of them switch from one message to another printed at separate locations on the sign. Thus, U.S. Pat. Nos. 2,897,617; 3,111,782; 3,748,767 and 4,217,713; British Nos. 441,846 and 1,176,837; and French No. 745,356 all operate in this way.

The drawback of all of these signs is that they are not compact. Thus, "OPEN-CLOSED" requires at least 12 spaces in width in the two British patents, and considerably more in U.S. Pat. Nos. 3,748,767 and 4,217,713. This means that a sign on the office of a gas station, for example, to be visible to motorists in the street, would have to be extremely large. The prior art signs have not generally been designed for compactness.

One sign that is compact is shown in U.S. Pat. No. 4,485,576. While it shows "OPEN-CLOSED", it does so in odd-shaped apertures, arrows and a confusing display that requires exceedingly careful registry.

There is a need for a compact sign that reuses information displayed on spaces and apertures of the same size so that registry problems and non-essential displays are avoided, while at the same time one of two alternate messages is displayed.

SUMMARY OF THE INVENTION

In my prior patent application Ser. No. 700,492, filed Feb. 11, 1985, I described and claimed a compact sign of three panels capable of showing either of two messages by re-using certain elements of information placed on the middle panel and showing information on the back panel through apertures in the middle panel. The front panel covers one space on either side of the middle panel.

The format of the "OPEN-CLOSED" sign described in my prior patent is compact in that it is only eight spaces wide, and each space and aperture is of precisely the same size and shape.

I now have found that other messages can be displayed in a three-panel sign with a middle panel slidable between two modes. Also the horizontal orientation of my prior application is not essential. The message may be displayed vertically. In a gas station, for example, the glass in a door is often larger vertically than horizontally, so a large compact sign in the door window can indicate whether it is open or closed.

The same format can be used for "ON SALE-SOLD", "MEN-WOMEN", "SAFE-UNSAFE", "ON-OFF", etc. Arrows showing direction may indicate up, down, left, or right simply by orienting the sign vertically or horizontally.

DESCRIPTION OF THE PREFERRED EMBODIMENTS

In each embodiment of the present invention there is a front panel, a middle panel and a back panel. The front panel has an aperture of a given number of spaces in size. The sign may be oriented either horizontally or vertically as space requirements of the environment dictate. If the sign is oriented horizontally, as in FIGS. 1–5, then the aperture in the front panel will have n spaces in width and at least one space on either side of the aperture which is solid to cover one space on the middle panel when it is in the right mode as well as the left mode.

Figure 1:
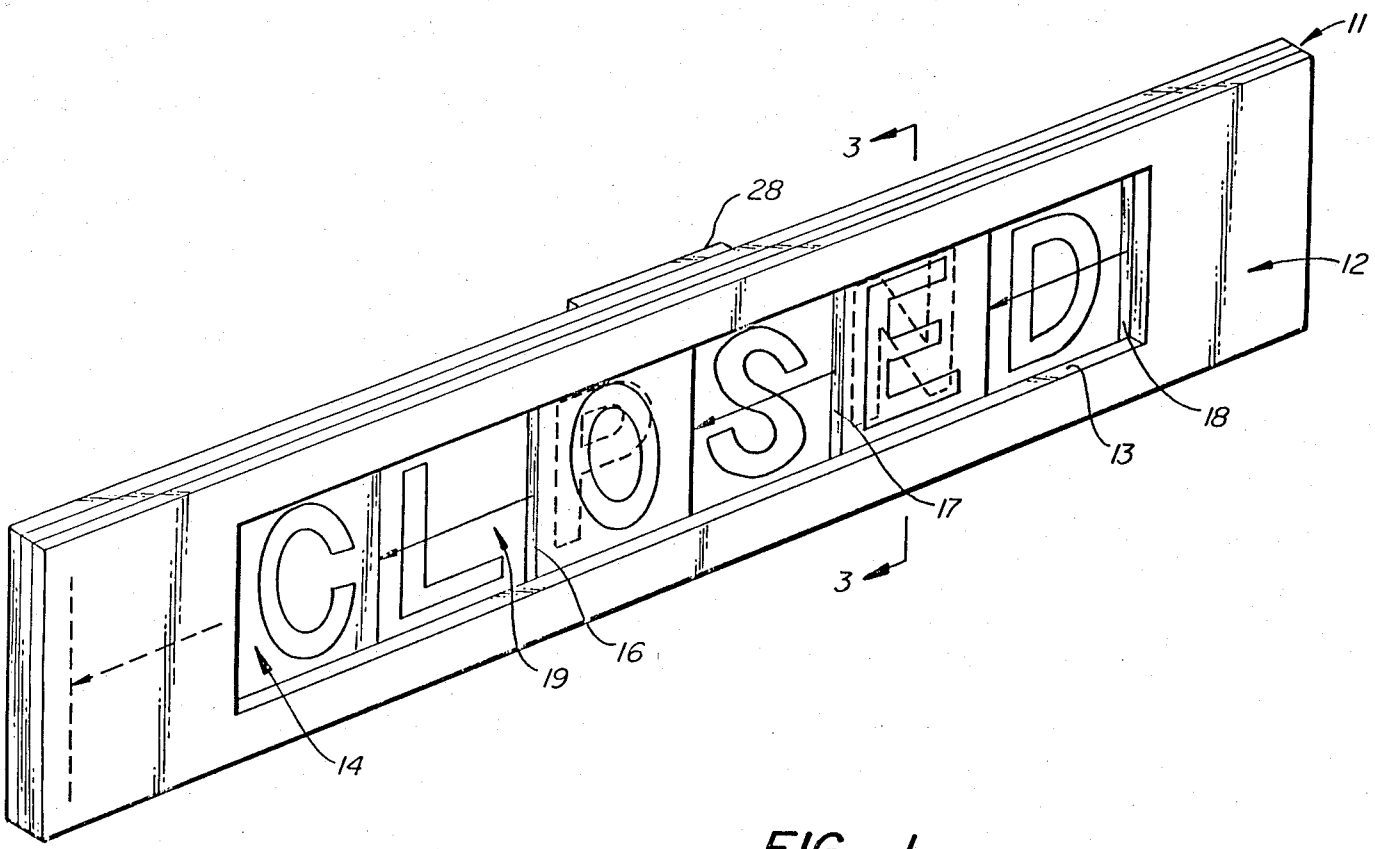
FIG. 1 is an isometric view of the OPEN-CLOSED sign in horizontal format.
Figure 2:
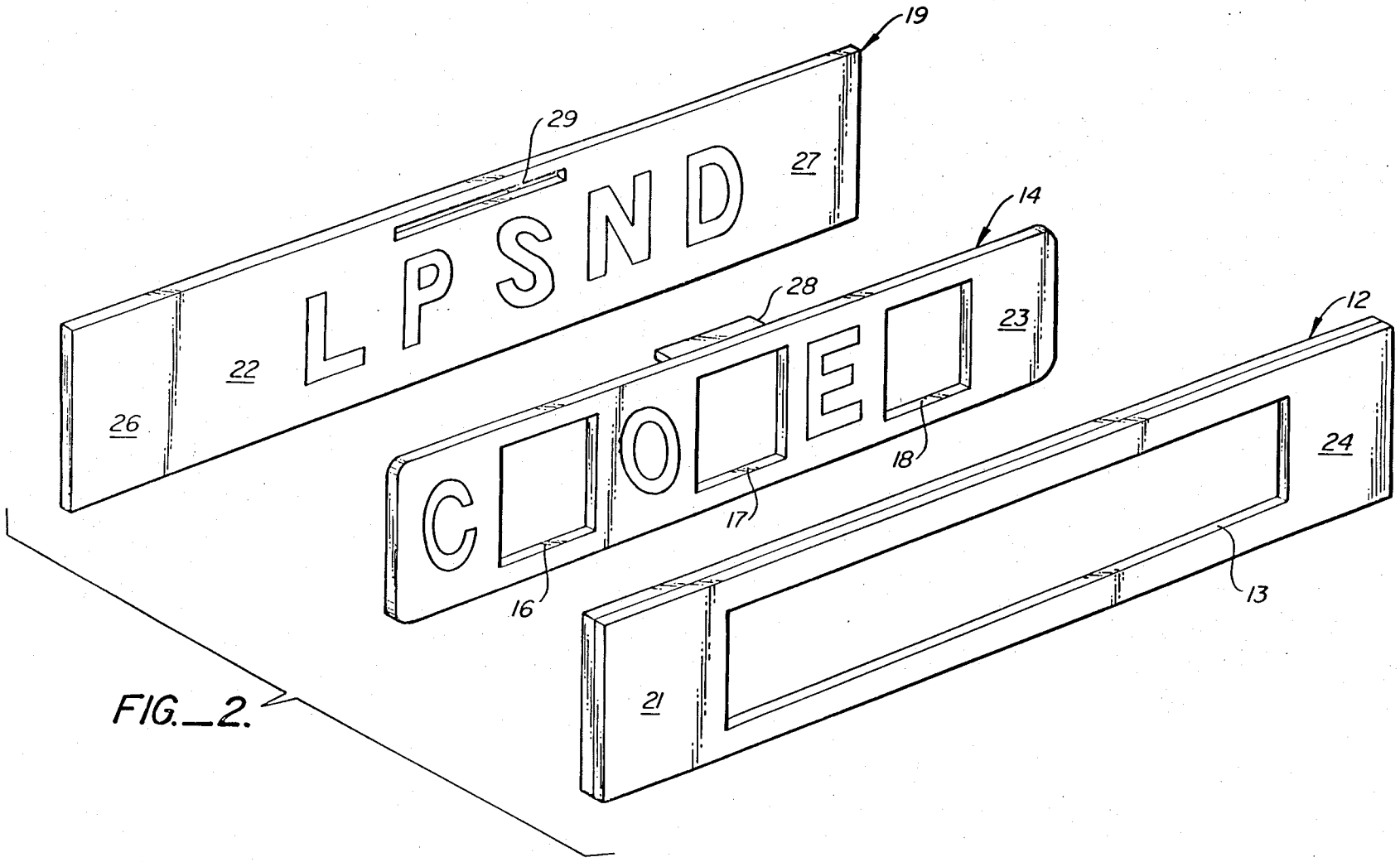
FIG. 2 is an exploded isometric view of the sign of FIG. 1.

Thus, referring to FIG. 1, sign 11 has a front panel 12 which is eight spaces in width: a six space aperture with a solid space on each side of the aperture. Aperture 13 allows the viewer to see through the front panel 12 to middle panel 14. As best shown in FIG. 2, middle panel 14 has the letters "C", "O", And "E", each followed by an aperture. The seventh space on panel 14 is a blank. When middle panel 14 is in the left mode, the letter "C" is hidden behind the solid first space of front panel 12. When the middle panel is moved to the right, the letter "C" is visible through the aperture 13 of the front panel, as in FIG. 1. The blank space at the right end of panel 14 is then behind the solid right end piece of front panel 12.

Back panel 19, like the front panel, is eight spaces long. As shown in FIG. 2, the first two spaces of panel 19 are blank. The next five spaces bear "L", "P", "S", "N", and "D", respectively. The last space is blank. When assembled as in FIG. 1, with panel 14 in the right mode, the first aperture in panel 14, the middle panel, shows the letter "L" on the back panel. The second aperture in the middle panel shows "S" from the back panel. The last aperture 18 in panel 14 shows "D" from the back panel. When panel 14 is moved to the left mode, aperture 16 permits viewing blank space 22 in the back panel. Aperture 17 shows the letter "P" in the back panel. Aperture 18 shows the letter "N" in the back panel. Thus, with the letter "C" obscured by the front panel in the left mode, the sign shows "OPEN".

FIG. 2 shows how the spaces 21 and 24, at the ends of panel 12, cover the corrsponding spaces 26 and 27 in back panel 19. The movable center panel 14 has the letter "C" behind space 21 of front panel 12 in the left mode. Blank space 23 covers the letter "D" in the left mode, and is behind space 24 in the right mode.

Figure 3:
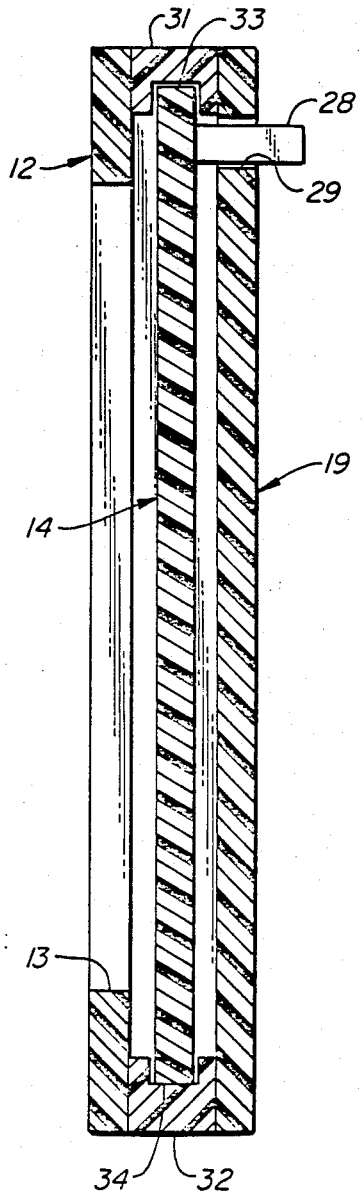
FIG. 3 is a cross-section view taken along line 3—3 of FIG. 1.

FIG. 3 shows grooves 33 and 34 in spacers 31 and 32, respectively, to facilitate movement of the center panel.

FIGS. 1–3 show tab 28 extending through opening 29 in the back panel. An alternative configuration of a tab for shifting registry is shown in FIGS. 4—13, where the tab is merely an extension of the middle panel, extending upwardly (FIGS. 4 and 5), or to the right (FIG. 6). Of course, the tab may extend below the middle panel or to the left, as desired. FIG. 13 shows an embodiment with a downwardly protruding tab.

Figure 4:
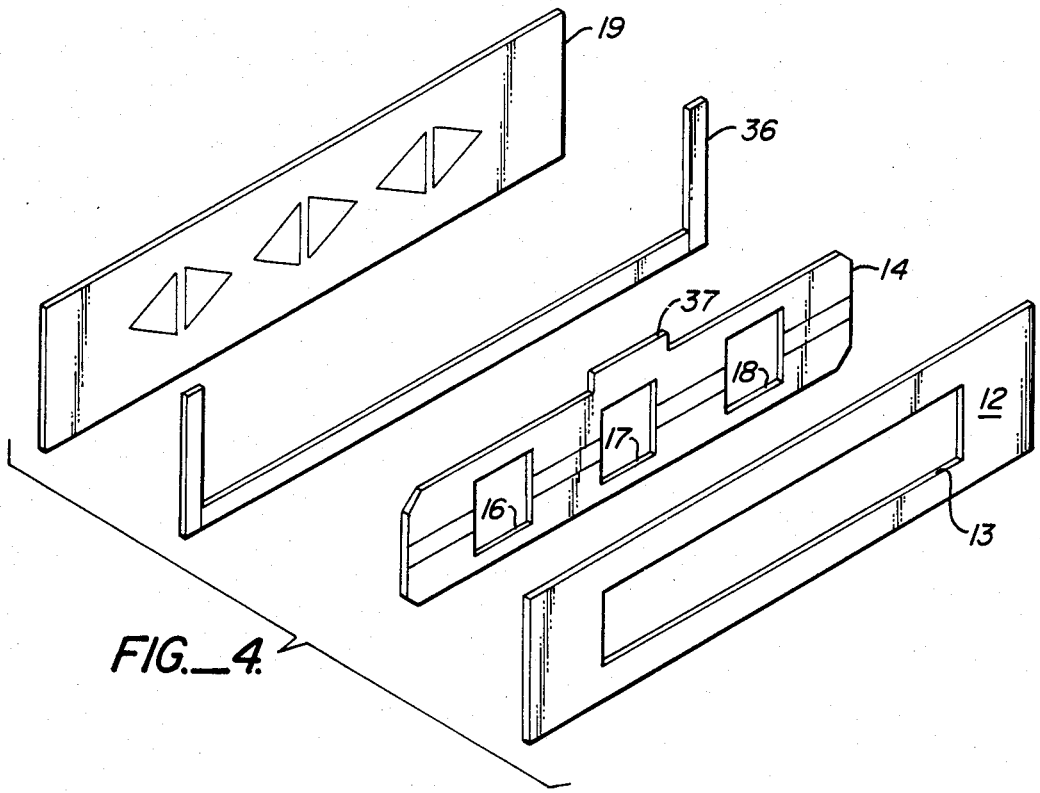
FIG. 4 is an exploded isometric view of the horizontal arrow format of the present invention.

FIG. 4 is an exploded view of a non-verbal form of the invention. As in FIGS. 1—3, front panel 12 has 8 spaces in length, with a six-space aperture 13. Middle panel 14 has seven spaces, in this embodiment solid horizontal bars in the first, third, fifth, and seventh spaces. Apertures exist in the second, fourth, and sixth spaces. The spacer in FIG. 4 differs slightly from that in the previous embodiment in that it is a U-shaped separator, as contrasted to the top and bottom channels 31 and 32 in the first embodiment. Spacer 36 accommodates the sliding of middle panel 14 between right and left modes. Back panel 19 again has eight spaces. The first and last are blank, and the remaining spaces carry opposing arrow heads to connect to the arrow shafts on the middle panel. Tab 37 facilitates the sliding of the middle panel.

Figure 5:
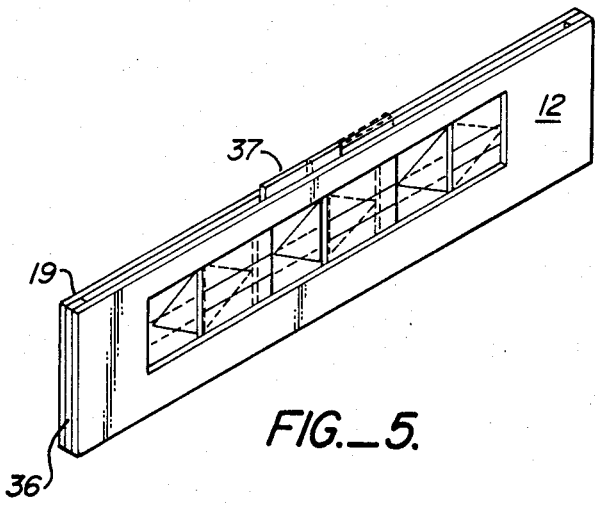
FIG. 5 is an isometric view, partially in phantom, of the horizontal arrow sign.

FIG. 5 shows the sign of FIG. 4 in practice. The left mode is shown in solid lines and the right mode is shown in dotted lines. It can be seen that the sign can be switched to direct traffic or otherwise give directions to viewers.

Figures 6A, 6B:
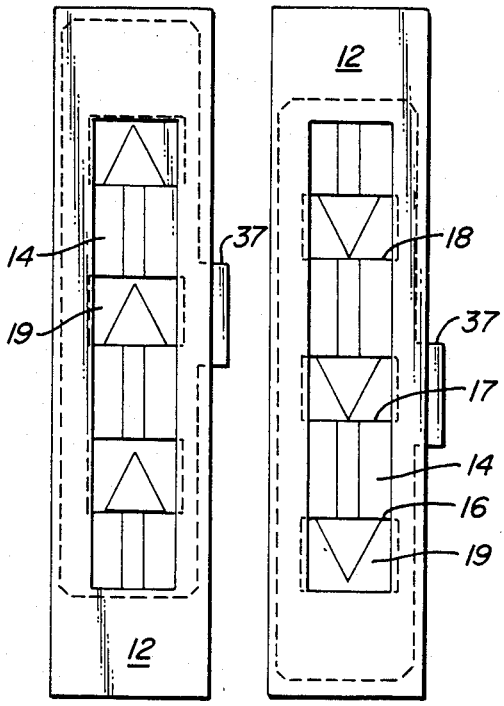
FIG. 6A is a front view, partially in phantom, of the vertical arrow sign in the up mode.
FIG. 6B is a front view, partially in phantom, of the vertical arrow sign in the down mode.

FIG. 6A shows the vertical orientation of the arrow sign in the up mode. FIG. 6B reflects the same sign in the down mode. If tab 37 is put in the up position, middle panel 14 covers the down arrowheads (FIG. 6A). When tab 37 is slid down, middle panel 14 covers the up arrowheads of panel 19, permitting the down arrowheads to be seen through apertures 16, 17, and 18 (FIG. 6B).

Figure 7A:
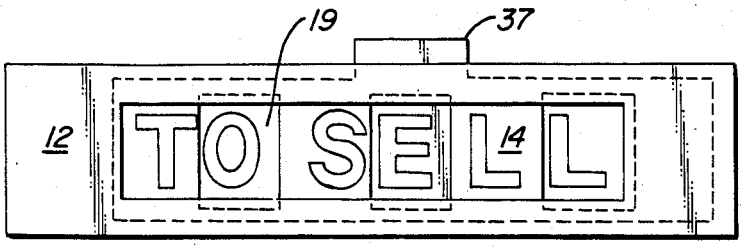
FIG. 7A is a front view, partially in phantom, of a TO SELL-SOLD sign in the right mode.
Figure 7B:
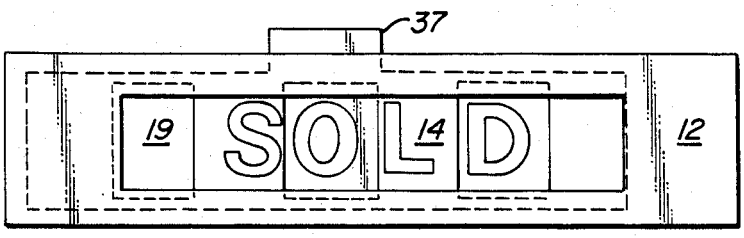
FIG. 7B is a front view, partially in phantom, of a TO SELL-SOLD sign in the left mode.

FIG. 7 shows one variation of a sign to be used for the sale of real estate or other products. In the right mode, shown in FIG. 7A, front panel 12 has 8 spaces, with a 6-space aperture. Middle panel 14 has 7 spaces, with "T", aperture, "S", aperture, "L", aperture, and blank, respectively. Back panel 19 exhibits blank, blank, "O", "O", "E", "D", "L", and blank in each of its 8 spaces. Even though each space and aperture is exactly the same size and shape, by careful placement of the letters within a space, a slight gap can be inserted between words for clarity. Thus, the first "O" on the back panel is located at the left edge of its space, and the "S" in the third space of the middle panel is slightly to the right of center of its space, giving sufficient distance between those two letters in the right mode to permit the viewer to see that two words are displayed (FIG. 7A). However, the "S" of the middle panel can still readily form the word "SOLD" when in the left mode (FIG. 7B).

Figure 8A:
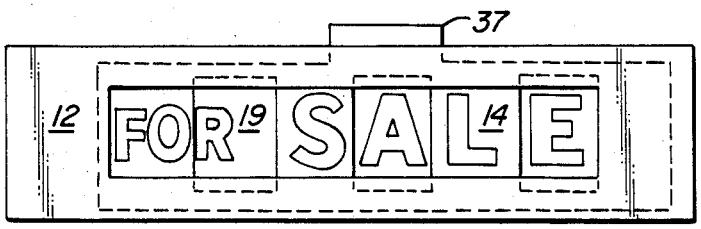
FIG. 8A is a FOR SALE-SOLD sign, partially in phantom, in the right mode.
Figure 8B:
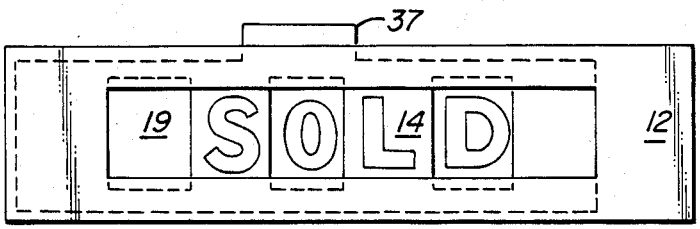
FIG. 8B is a FOR SALE-SOLD sign, partially in phantom, in the left mode.

FIG. 8 shows another variation of the same message. FIG. 8A is the right mode with the separation of words being accomplished by using slightly smaller letters. Also, two letters, "F" and "O", appear on the first space of the middle panel. This is done by having a smaller type font for the word "for". Middle panel 14 also has aperture, "S", aperture, "L", aperture, and blank in the remaining spaces. The back panel has two blanks followed by a small "R", "O", "A", "D", "E", and a blank in its 8 spaces. By having the small "R" at the left edge of the third space of panel 19, the word FOR is separated from the larger word SALE in the right mode of FIG. 8A. FIG. 8B is virtually identical to FIG. 7B, except there is no need to squeeze the letter "S" to the right of its space in FIG. 8B because of the smaller type font for the first word.

Figure 9A:
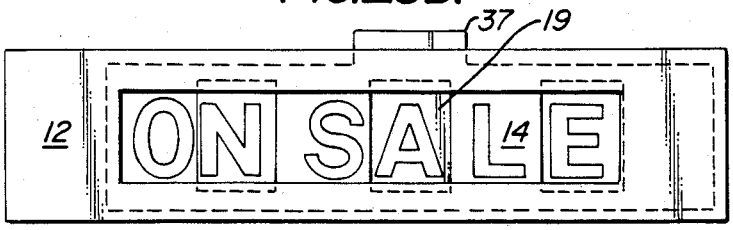
FIG. 9A is an ON SALE-SOLD sign, partially in phantom, in the right mode.
Figure 9B:
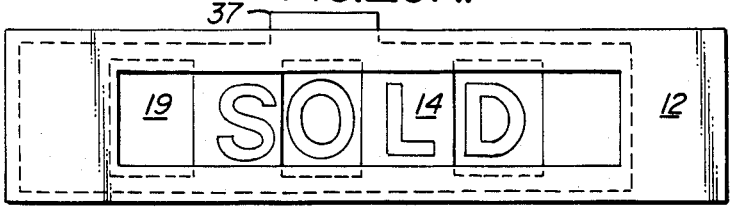
FIG. 9B is an ON SALE-SOLD sign, partially in phantom, in the left mode.

FIG. 9 is still another variation on the same theme. Here, the letters are all the same size, as in FIG. 7, but the first word is "ON", rather than "TO", and the second word in the right mode is "SALE". This means that panel 14 in FIG. 9 bears "O", aperture, "S", aperture, "L", aperture, and blank, and panel 19 bears two blanks, "N", "O", "A", "D", "E", and blank.

Figure 10A:
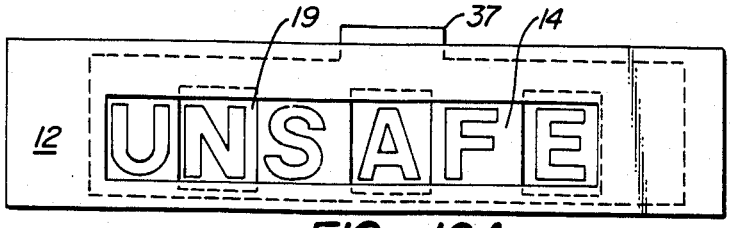
FIG. 10A is a SAFE-UNSAFE sign, partially in phantom, in the right mode.
Figure 10B:
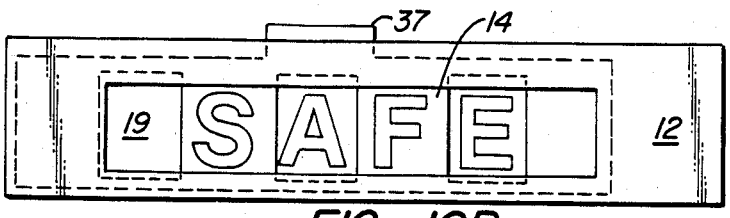
FIG. 10B is a SAFE-UNSAFE sign, partially in phantom, in the left mode.

FIG. 10 relates to an industrial application for the alternative messages SAFE or UNSAFE. The right mode of FIG. 10A has a front panel 12 of 8 spaces, and an aperture of 6 spaces. Middle panel 14 has 7 spaces: "U", aperture, "S", aperture, "F", aperture, and blank, respectively. The left mode of FIG. 10B has the initial "U" on panel 14 obscured by the first space of front panel 12. Letters "S"and "F"of panel 14 are displayed in both left and right modes. Back panel 19 bears two blanks, "N", "A", "A", "E", "E", and a blank.

Figure 11A:
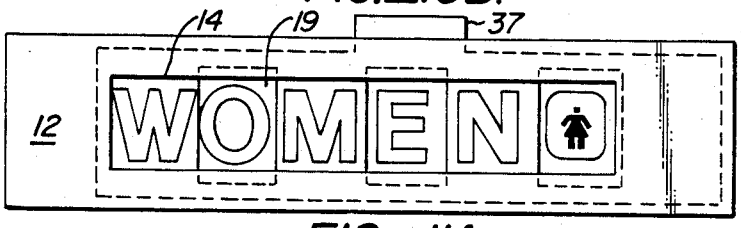
FIG. 11A is a MEN-WOMEN sign, partially in phantom, in the right mode.
Figure 11B:
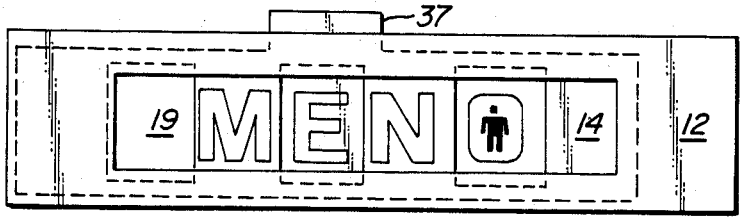
FIG. 11B is a MEN-WOMEN sign, partially in phantom, in the left mode.

FIG. 11 is useful to allow one restroom to be used alternatively for either men or women. In the right mode of FIG. 11A, the word WOMAN with the international symbol of a woman are shown. The word MAN and the symbol are displayed in the left mode of FIG. 11B. As before, panel 12 has 8 spaces, with an aperture of 6 spaces. Panel 14 bears "W", aperture, "M", aperture, "N", aperture, and a blank. Back panel 19 bears two blanks, "O", "E", "E", the symbol of a man, and a symbol of a woman, followed by a blank. The letters "M" and "N" are recycled through both right and left modes.

Figure 12A:
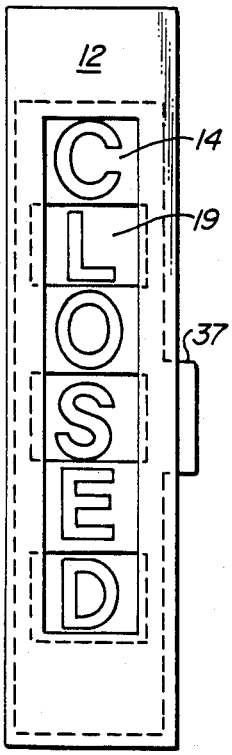
FIG. 12A is a front view, partially in phantom, of an OPEN-CLOSED sign in vertical format in the down mode.
Figure 12B:
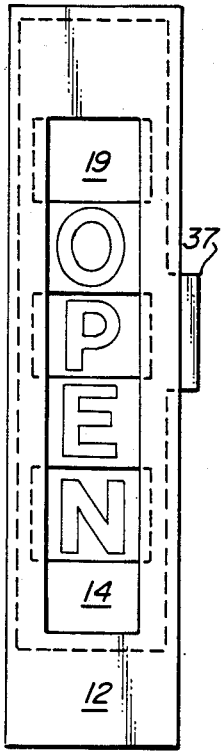
FIG. 12B is a front view, partially in phantom, of an OPEN-CLOSED sign in vertical format in the up mode.
Figure 13A:
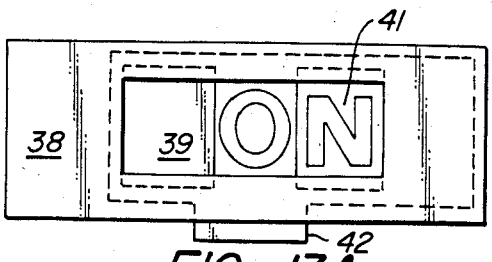
FIG. 13A is a front view, partially in phantom, of an ON-OFF sign, in the right mode.
Figure 13B:
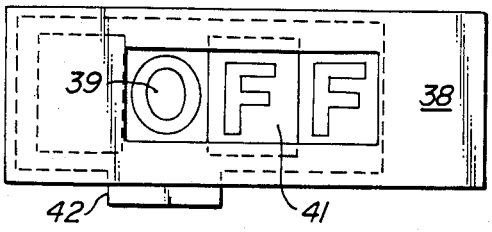
FIG. 13B is a front view, partially in phantom, of an ON-OFF sign, in the left mode.

FIG. 12 is exactly like FIGS. 1–3 in message, but the orientation is vertical rather than horizontal. Also tab 37 in FIG. 12 replaces protruding tab 28 in the earlier embodiment.

FIG. 13 is an example of a smaller sign having a total length of only 5 spaces. Of course, the orientation could be vertical like FIG. 12, but it is here shown as horizontal. The message is ON-OFF, and this is done with a front panel 38 showing blank, a three space aperture, and another blank. The middle panel 39 has 4 spaces: blank, "O", aperture, and "F". The back panel 41 has 5 spaces: two blanks, "F", and "N". In this embodiment, the tab 42 is shown as a downward extension of panel 39.

It is apparent that all signs may conveniently be controlled by electrical or mechanical means. However, the sign of FIG. 13 is particularly well suited for use with switching means (not shown) to enable the display to be used in electrical circuits, in conjunction with valves, and the like.

Accordingly, alternative messages may be displayed in a compact sign of n+2 spaces in length, with a front panel having an aperture n spaces wide, and a middle panel n+1 spaces long movable between two alternative positions to display either message, using information on the middle or back panels, viewable through appropriate apertures.

Other alternative messages and presentations will occur to one skilled in the art, this presentation of embodiments intended to be merely representative.

I claim:

1. In a sign intended to convey one of two messages about the status of the location where the sign is placed in a compact form whereby specific information placed on spaces of the sign are used in both messages, the improvement comprising:

(a) a front panel having an aperture one space in one dimension and n spaces in the other dimension and a solid cover of one space in width on eitner side of the aperture of n spaces;

(b) a middle panel having at least n+1 spaces and apertures of the same size and shape and at least some of the spaces containing information viewable through the aperture of the front panel, said middle panel being slidable with respect to the front panel between a first position and a second position, said first position with one space at one end of the middle panel covered by the solid cover on one side of the aperture on the front panel and said second position with one space at the opposite end of the middle panel covered by the solid cover at the opposite end of the aperture of the front panel; and (c) a back panel fixed with respect to the front panel, but capable of displaying different information in at least some of the spaces behind apertures in the middle panel in either the first or second position of the middle panel as the middle panel is moved from the first to the second position or vice versa.

2. A sign as in claim 1 wherein n is 6.

3. A sign as in claim 1 wherein the sign is horizontally oriented and n is 6;

the middle panel has seven spaces configured with the letters "F" and "O" appearing in the first space of the middle panel so that they are covered when the middle panel is in the left position and visible in the first space of the aperture when the middle panel is in the right position; the second fourth and sixth spaces of the middle panel are apertures, the third space of the middle panel bears the letter "S"; the fifth space on the middle panel bears the letter "L"; and the last space of the middle panel is blank; and the back panel has six spaces configured as a blank, "R", "O", "A", "D" and "E";

whereby the sign reads "SOLD" in the left position and "FOR SALE" in the right position of the middle panel.

4. A sign as in claim 1 wherein the sign is horizontally oriented and n is 6;

the middle panel of seven spaces is configured with "O", aperture; "S", aperture; "L", aperture and a blank space;

the back panel of six spaces has blank space, "N", "O", "A", "D" and "E";

whereby the sign reads "SOLD" in the left position and "ON SALE" in the right position of the middle panel.

5. A sign as in claim 1 wherein the sign is horizontally oriented and n is 6;

the middle panel of seven spaces is configured with "T", aperture; "S", aperture; "L" and a blank space;

the back panel of six spaces has blank space, "O", "E", "D" and "L";

whereby the sign reads "SOLD" in the left position and "TO SELL" in the right position of the middle panel.

6. A sign as in claim 1 wherein the sign is vertically oriented and n is 6;

the middle panel has seven spaces configured from top to bottom with "C", aperture; "O", aperture; "E", aperture, and a blank space;

the back panel has six spaces configured from top to bottom with a blank space, "L", "P", "S", "N" and "D";

whereby the sign reads "OPEN" in the up position of the middle panel and "CLOSED" in the down position.

7. A sign is in claim 1 wherein the sign may be either vertically or horizontally oriented to either point up-down or right-left, and n is 6;

the middle panel has seven spaces configured with a solid bar across in the horizontal mode or vertically in the vertical mode in the first, third, fifth and seventh spaces and the second, fourth and sixth spaces are apertures; and the back panel has six spaces with arrow heads pointing in one direction in the first third and fifth spaces and arrow heads pointing in the opposite direction in the rest.

8. A sign as in claim 1 wherein the sign is horizontally oriented and n is 6;

the middle panel of seven spaces is configured with "U", aperture; "S", aperture; "F", aperture and a blank space;

the back panel of six spaces has blank space, "N", "A", "A", "E" and "E";

whereby the sign reads "SAFE" in the left position and "UNSAFE" in the right position of the middle panel.

9. A sign as in claim 1 wherein the sign is horizontally oriented and n is 6;

the middle panel of seven spaces is configured with "W", aperture; "M", aperture; "N", aperture and a blank space;

the back panel of six spaces has blank space, "O", "E", "E", international symbol of a man and international symbol of a woman;

whereby the sign reads "MEN" with a figure of a man in the left position and "WOMEN " with a figure of a woman in the right position of the middle panel.

10. A sign as in claim 1 wherein n is 3;

the middle panel has four spaces configured: blank, "O", aperture and "F", reading from left to right or top down;

the back panel has the spaces configured: blank, "F" and "N", reading left to right or top down;

whereby the sign reads "OFF" in the left or up position, and "ON" in the right or down position of the middle panel.

* * * * *